US006723480B2

(12) United States Patent
Yahagi et al.

(10) Patent No.: US 6,723,480 B2
(45) Date of Patent: Apr. 20, 2004

(54) SUBSTRATE FOR ELECTROPHOTOGRAPHY PHOTOSENSITIVE BODY, ELECTROPHOTOGRAPHY PHOTOSENSITIVE BODY, AND ELECTROPHOTOGRAPHY DEVICE

(75) Inventors: Hidetaka Yahagi, Nagano (JP); Naoyuki Senba, Nagano (JP); Masaru Kobashi, Nagano (JP); Mikio Yamazaki, Nagano (JP); Shinichiro Nishimaki, Nagano (JP); Yutaka Nakagishi, Osaka (JP); Masaaki Sakaguchi, Osaka (JP)

(73) Assignee: Fuji Electric Imaging Device Co., Ltd., Nagano (JP)

( * ) Notice: Subject to any disclaimer, the term of this patent is extended or adjusted under 35 U.S.C. 154(b) by 0 days.

(21) Appl. No.: 10/091,368

(22) Filed: Mar. 5, 2002

(65) Prior Publication Data

US 2003/0013030 A1 Jan. 16, 2003

(30) Foreign Application Priority Data

Mar. 6, 2001 (JP) ..... 2001-061547

(51) Int. Cl.[7] ..... G03G 5/14

(52) U.S. Cl. ..... 430/65; 430/60; 430/64

(58) Field of Search ..... 430/65, 60, 64

(56) References Cited

U.S. PATENT DOCUMENTS 6,037,089 A * 3/2000 Yahagi et al. ..... 430/65

FOREIGN PATENT DOCUMENTS

| | | |
|---|---|---|
| JP | 05034964 | 2/1993 |
| JP | 10333342 | 12/1998 |
| JP | 11038662 | 2/1999 |
| JP | 11084705 | 2/1999 |

* cited by examiner

*Primary Examiner*—Mark A. Chapman
(74) *Attorney, Agent, or Firm*—Darby & Darby

(57) ABSTRACT

The object of the present invention is to provide an electrophotography photosensitive body substrate, photosensitive body, and electrophotography device used in a contact charging process that can prevent the occurrence of minor insulation damage of around diameter 0.1–0.5 mm.

In an electrophotography photosensitive body substrate having a sealed aluminum anodic oxidation film on its surface, the anodic oxidation film is sealed by a sealing agent in which an anion surface active agent is beneficially added.

15 Claims, 1 Drawing Sheet

SUBSTRATE FOR ELECTROPHOTOGRAPHY PHOTOSENSITIVE BODY, ELECTROPHOTOGRAPHY PHOTOSENSITIVE BODY, AND ELECTROPHOTOGRAPHY DEVICE

BACKGROUND TO THE PRESENT INVENTION

1. Field of the Invention

The present invention relates to a substrate for an electrophotography photosensitive body and an electrophotography photosensitive body that uses an electrophotography process with at least one contact charging method as a charging mechanism (henceforth referred to a contact charging process). The present invention also relates to an electrophotography device equipped with this photosensitive body.

2. Description of the Related Art

Traditionally, the technology for electrophotography had developed in the field of the copier machine.

Recently, it has also been applied to laser printers and the like, and compared to the prior impact printers, these laser printers are much improved in terms of image quality, speed, and quietness. The electrophotography photosensitive body mounted onto these devices is formed by providing a photoconductive layer on a surface of a conductive cylindrical substrate.

Photoconductive organic materials are typically included in the materials for this photoconductive layer. In general, its layer structure is a function-separated structure (layered type). This layered type is commonly a negative charging type photosensitive body in which an undercoat layer (UCL), a charge generating layer (CGL), and a charge transport layer (CTL) are laminated in that order on top of an aluminum substrate.

For the undercoat layer, a layer that is primarily of a polyamide resin is commonly used. However, although this undercoat layer is inexpensive, there are many problems in terms of environmental resistance. In particular, there can be significant fluctuations in its properties due to humidity. As a way to combat this problem, instead of the polyamide resin film described above, an anodic oxidation film that is formed by anodic oxidation treatment of an aluminum substrate is used as the undercoat layer. In particular, in high temperature and high humidity environments, the anodic oxidation film is thought to have better reliability.

In the related art, a corona charging method is often used for the charging mechanism in the electrophotographic process. However, recently, for the purposes of improving charging efficiency and miniaturizing the device and reducing ozone amounts and the like, devices that use a contact charging method have been increasing.

The contact charging method conducts charging by direct contact of the charging member with the photosensitive body surface. However, with the contact charging method, any small irregularities on the substrate surface can easily result in damage to the insulation of the photosensitive layer.

In addition to contact charging devices used in charging processes in the electrophotography process, the contact charging devices described here also include devices that charge by contact with the electrophotography photosensitive body such as contact transfer devices used in a transfer process and the like.

With contact transfer, because paper and the like are normally present between the photosensitive body and the contact transfer device, insulation damage does not readily occur. However, with cut paper, direct contact between the photosensitive body and the contact transfer device cannot be avoided between one page and the next. As a result, damage to insulation is similarly a problem.

In particular, when OHP sheets are used, because the transfer voltage becomes high, insulation damage occurs readily. Stated more concretely, when small defects in the material on the substrate surface or small splinters from cutting the substrate surface are present, the electric field becomes concentrated in that area when voltage is applied, and damage to the insulation occurs.

When damage to the insulation occurs, in reverse developing systems, this results in black spots on white parts, and in normal developing, this becomes white spots in black parts. When these spots are numerous, they can prove to be a serious printing obstacle. In particular, in the case of reverse developing, even small black dots appear readily, and this becomes a frequent problem.

Various improvements have been proposed for this problem arising from insulation damage. For example, Japanese Patent Number 2661418, discloses a method for anodic oxidation of the surface of the aluminum substrate used for the photosensitive body.

Unfortunately, after a detailed examination by the present inventors, by using this method alone, only the problem of comparatively large printing defects of diameter 0.5 mm or greater was sightly minimized, and the practical problem of minute printing defects (diameter of approximately 0.1–0.5 mm) due to leakage (insulation damage) during charging was not sufficiently resolved. Consequently, this disclosure has not proved successful in solving the problems noted above.

OBJECT AND SUMMARY OF THE INVENTION

It is an object of the present invention to overcome the concerns raised and discussed above.

It is another object of the present invention is to provide an electrophotography photosensitive body substrate and an electrophotography photosensitive body in which an electrophotography photosensitive body, wherein the body includes a substrate having a sealed aluminum anodic oxidation film on its surface and a photosensitive layer on top of this substrate surface, and used in a contact charging process, and thereby prevent the creation of small insulation damage of around diameter 0.1–0.5 mm.

It is another object is to provide an electrophotography device using this photosensitive body.

It is another object of the present invention is to provide the above substrate, electrophotography photosensitive body, and electrophotography device that are used in a contact charging system of a reverse developing system.

According to one embodiment of the present invention, the above object is achieved by an electrophotography photosensitive body substrate having an aluminum anodic oxidation film on its surface and being used in a contact charging process, wherein: the anodic oxidation film is a film that is sealed by a sealing agent in which an anion surface active agent is added.

According to another embodiment of the present invention, there is provided an electrophotography photosensitive body substrate, wherein: the sealed aluminum anodic oxidation film is a film that is sealed by a sealing agent in which an anion surface active agent is added in an amount necessary for preventing the formation of sealing deposits.

According to another embodiment of the present invention, there is provided an electrophotography photosensitive body substrate as described in any embodiment supported, wherein: a phosphoric ester surface active agent is used as the anion surface active agent.

According to another embodiment of the present invention, there is provided an electrophotography photosensitive body substrate as described in any embodiment above or below, wherein: the phosphoric ester surface active agent has a concentration of 0.1–2.0 g/l with respect to water.

According to another embodiment of the present invention, there is provided an electrophotography photosensitive body substrate as described in any embodiment above or below, wherein: a formaldehyde condensate of naphthalene sulfonate is used as the anion surface active agent.

According to another embodiment of the present invention, there is provided an electrophotography photosensitive body substrate as described any embodiment above, wherein: the formaldehyde condensate of naphthalene sulfonate has a concentration of 0.1–3.0 g/l with respect to water.

According to another embodiment of the present invention, there is provided an electrophotography photosensitive body substrate as described any embodiment provided herein, wherein: a formaldehyde condensate of bisphenol A sulfonate is used as the anion surface active agent.

According to another embodiment of the present invention, there is provided an electrophotography photosensitive body substrate as described in each embodiment discussed, wherein: the formaldehyde condensate of bisphenol A sulfonate has a concentration of 0.2–5.0 g/l with respect to water.

According to another embodiment of the present invention, there is provided an electrophotography photosensitive body substrate as described in any embodiment above, wherein: nickel acetate is added to the sealing agent.

According to another embodiment of the present invention, the objects discussed above are provided by an electrophotography photosensitive body that uses an electrophotography photosensitive body substrate as described any embodiment discussed above or below.

According to another embodiment of the present invention, the above objects may be achieved by an electrophotography device, comprising: an embodiment of an electrophotography photosensitive body described above, and an embodiment of a contact charging device.

According to another embodiment of the present invention, it is preferable to have an electrophotography device of any embodiment described which is a reverse development system.

Although the detailed mechanism for the present invention is not known, in the sealing treatment of the aluminum anodic oxidation film, the anion surface active agent of a specified concentration contained in the sealing agent adjusts the uniformity of the sealing of the film surface and inhibits the formation of surface sealing deposits which can cause insulation damage by concentrating the electric field.

Stated more concretely, the surface active agent described above dissolves out from the aluminum anodic oxidation film and is adsorbed onto the surface of hydrated aluminum that is dissolved in the sealing solution, or it is adsorbed onto the aluminum anodic oxidation film surface.

As a consequence, the aggregation of particles of hydrated aluminum, or their deposition onto the anodic oxidation film surface is prevented, and as a result, the creation of sealing deposits becomes difficult.

With nickel acetate sealing in which nickel acetate is further added to the sealing agent, by the surface active agent of the present invention, the accumulation of hydrolyzed nickel hydroxide onto the sealing surface is similarly and beneficially prevented.

In simple terms, the surface active agent of the present invention is a compound with a hydrophilic portion and a lipophilic portion both in one molecule.

With regard to the properties of the surface active agent in a solution or a dispersion solution, it is adsorbed and oriented at the solvent and solute or dispersoid interface, and it has the action of lowering the interfacial tension.

According to the ionic property shown when there is partial dissociation of the lipophilic portion, they are largely divided into anionic, cationic, amphoteric, non-ionic surface active agents and the like.

Anionic surface active agents of the present invention include carboxylates, sulfonates, sulfate esters, phosphoric esters, polymerized polymers, and polycondensation polymers, and the like.

In the present invention, all of the classes described above are effective as anionic surface active agents, but phosphoric ester surface active agent and naphthalene sulfonate formaldehyde condensate, which is a polycondensation polymer, are especially well suited.

Phosphoric ester surface active agents are Phosphanol RS610 manufactured by Toho Kagaku Kogyo Corp. Ltd., Adecacole PS, CS, TS, manufactured by Asahi Denka Kogyo Corp. Ltd., Electrostripper N, K manufactured by Kao Corp. Ltd.

Formaldehyde condensates of naphthalene sulfonate are Demol N, RN, NL, RN-L, T manufactured by Kao Corp. Ltd.; Ionet D-2 manufactured by Sanyo Kasei Kogyo Corp. Ltd., and Lunox 1000 manufactured by Toho Kagaku Kogyo Corp. Ltd.

Formaldehyde condensates of bisphenol A sulfonates include AMN-1 manufactured by Senca Corp. Ltd.

The amount of these surface active agents added to the sealing agent has a close relationship with the formation of sealing deposits. The amount needed in the present invention is different and particular for each surface active agent. This is determined by whether the formation of sealing deposits that causes insulation damage leading to image defects is prevented.

Preferably, the amount of the anionic surface active agent added to the sealing agent is in the range of 0.01–10 g/l with respect to pure water.

In Japanese Laid-Open Patent Publication Number 10-333342, there is a description of including a surface active agent in the rinsing solution after sealing treatment. Unfortunately, in this case, the rinsing solution that has the surface active agent is not used for dissolving and eliminating deposits during sealing as described above. Therefore, the technical idea of the two is completely different.

In Japanese Laid Open Patent Number 11-84705, paragraph 0023, states "In the sealing treatment process of both high temperature sealing treatment and low temperature sealing treatment, a surface active agent can be included in the treatment solution for the purposes of improving the wettability of the treatment solution, or a surface active agent is not included." However, later, there is also stated that "preferably, a surface active agent is not included." Consequently, in the embodiments described afterwards, a surface active agent is not included in the sealing solution. Thus this brief comment is supportably excludable.

In Japanese Patent Number 2661418, it states that a surface active agent can be added to a sealing solution of nickel fluoride or nickel acetate. However in the embodiments to be described, there are no concrete examples in which surface active agents are added.

In Japanese Laid Open Patent Number 11-38662, the same inventors as the present invention achieved a specified admittance value by adding a specified anionic surface active agent to the sealing solution. The growth of the film in the vertical direction is suppressed, and a photosensitive body having a highly sealed surface that is uniform and smooth with a high wettability is provided. As the specified anionic surface active agent only, phosphoric esters, formaldehyde condensate of naphthalene sulfonate, formaldehyde condensate of bisphenol A sulfonate are disclosed or supported.

As will be noted below, there is no disclosure, or even any indication of the present invention, which relates to the relationship between the optimal addition amount (concentration) for these specified anionic surface active agents in the sealing solution and the insulation damage that is readily generated when a photosensitive body, that uses a photosensitive substrate equipped with an aluminum anodic oxidation film that has been sealed, is used in an electrophotography device with a contact charging process.

The above, and other objects, features, and advantages of the present invention will become apparent from the following description read in conjunction with the accompanying drawings, in which like reference numerals designate the same elements.

DESCRIPTION OF THE PREFERRED EMBODIMENTS

Below, referring to the figures, there is a detailed description of the electrophotography photosensitive body substrate and an electrophotography device using the photosensitive body. It should be specifically understood, that the present invention is not limited to the following description.

Figure 1:
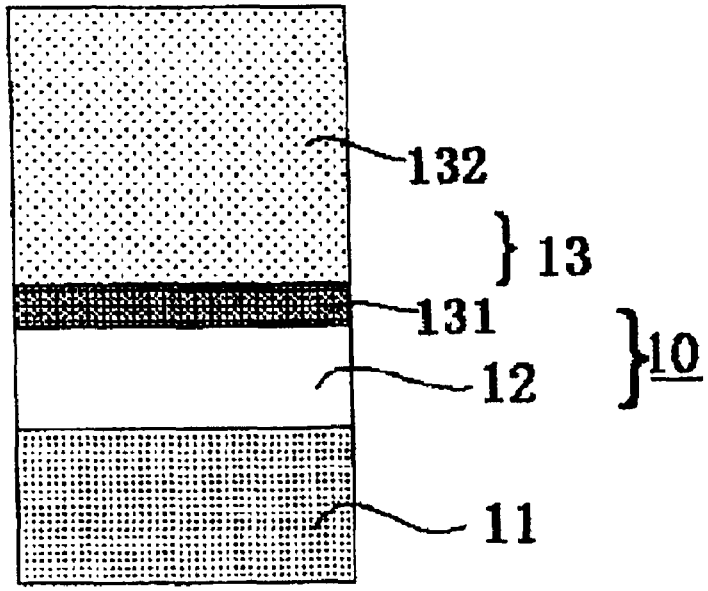
FIG. 1 is a model cross-sectional diagram of the principal parts of the electrophotography photosensitive body of the present invention.

Referring to FIG. 1, there is a model cross-section of an electrophotography photosensitive body 10 used in a contact charging process of the present invention.

A photosensitive layer 13 is layered on top of an aluminum anodic oxidation film 12 which is formed on top of an electrophotography photosensitive body substrate 11. In photosensitive layer 13, a charge transport layer 132 is layered on top of a charge generating layer 131.

Figure 2:
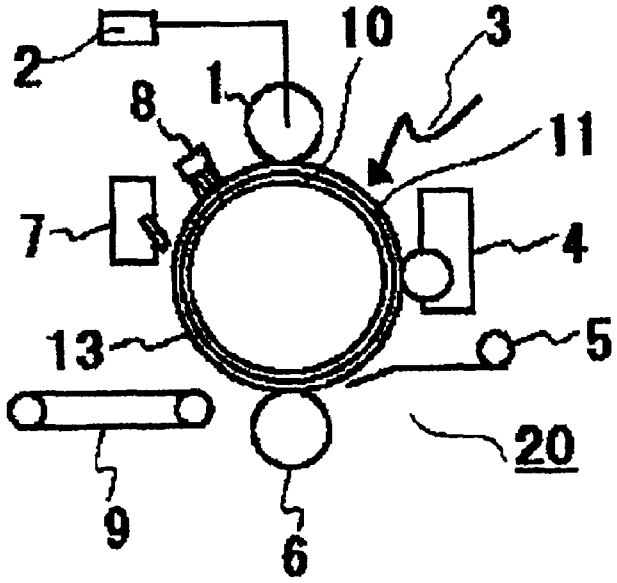
FIG. 2 is a schematic block diagram of an electrophotography device that uses an electrophotography photosensitive body of the present invention.

Referring to FIG. 2, there is a schematic drawing of an electrophotography device that includes an electrophotography process that uses a contact charging method.

In this process, a roller charging member 1, an image exposure means 3, a developer 4, a paper supplying roller and a paper supply guide 5, a transfer charging device (direct charging type) 6, a cleaner 7, a charge removal means 8 are placed on the surface of electrophotography photosensitive body 10, which comprises substrate 11 and photosensitive layer 13 that surrounds its outer surface.

In the method of image formation, first, a voltage supplied from a power source (not shown) is applied to charging member 1 which is placed in contact on top of electrophotography photosensitive body 10, and the surface of photosensitive body 10 is charged.

An image corresponding to the original is image exposed by an image exposure means 3, and an electrostatic latent image is formed. Next, by having the toner in developer 4 adhere to photosensitive body 10, the electrostatic latent image on photosensitive body 10 is developed (made into a visible image).

In addition, the toner image formed on top of photosensitive body 10 is transferred by transfer charging device 6 to a transfer material of paper or similar material which is supplied through a paper supply roller and paper supply guide 5. Residual toner remaining on photosensitive body 10 that is not transferred to the transfer material is recovered by cleaner 7.

In case residual charge remains inside photosensitive layer 13, a suitable voltage is applied to photosensitive body 10 by charge removal means 8, and charge is removed, or charge removal can be conducted using light. The transfer material on which the toner image is formed is sent to a fixing device (not shown) by a transport part 9, and the toner image is fixed.

In this electrophotography device, the light source for image exposure means 3 is a halogen light, fluorescent light, laser light and similar device. Other supplemental processes can be added as needed. The charging process by contact of the present invention is not only conducted in the charging process but also conducted in the transfer process.

This type of electrophotography device includes not only copiers, but also laser beam printers, facsimiles, electrophotography printing systems.

Referring again to FIG. 2, for charging roller 1, a shaft (core material) of a stainless rod of 6 mm phi for example is covered using a conductive EPDM rubber of resistivity $10^8$ ohm cm to achieve 12 mm phi, and in addition, a surface layer of a polyamide resin with a resistivity of $10^{10}$ ohm cm is formed with a thickness of 0.1 $\mu$m.

Charging roller 1 contacts photosensitive body 10 at a suitable pressure (a weighting of 5N/cm on the shaft of the charging roller). A pulsating voltage in which a between-peak voltage of 2.0 KV is overlaid on a direct current voltage of 1.0 KV is applied from a high voltage power source (not shown) onto charging roller 1, and the surface of photosensitive body 10 is charged.

For the shape of the contact charging member, in addition to the roller, a brush-shape or a blade-shape can also be used.

In the electrophotography photosensitive body of the present invention, after forming an anodic oxidation film of aluminum, sealing is conducted by a treatment solution that contains an anionic surface active agent, particularly a phosphoric ester surface active agent, a formaldehyde condensate of naphthalene sulfonate, formaldehyde condensate of bisphenol A sulfonate, and the like, at a specified concentration.

By forming a photosensitive layer on the resulting substrate, the electrophotography photosensitive body of the present invention is created.

Next, a concrete construction of the electrophotography photosensitive body of the present invention is described.

Generally, for photosensitive bodies, there is a negatively charged function-separated layered photosensitive body, a positively charged function-separated layered photosensitive body, and also a positively charged single-layer photosensitive body and the like.

The negatively charged function-separated layered photosensitive body is the preferred mode of the present invention, and an example of this will be described concretely.

In the negatively charged function-separated layered photosensitive body, in general, a photosensitive layer is layered on top of an undercoat layer which is formed on top of a conductive substrate.

In the present invention, for the undercoat layer, an anodic oxidation film of aluminum is formed, and a special sealing is conducted. In the photosensitive layer, a charge transport layer is layered on top of a charge generating layer. This is a function-separated type in which the charge generating layer and the charge transport layer are functionally separated.

The conductive substrate acts as an electrode for the photosensitive body, but it also functions as a support body for each of the other layers. The conductive substrate is an aluminum substrate that can be cylindrical, a sheet-shape, or a film-shape. For the material quality of aluminum, an aluminum alloy as provided in JIS 3003,6063 is preferred. This aluminum substrate has an anodic oxidation film as described above on its surface.

The charge generating layer is formed by vacuum deposition of an organic photoconductive substance or by coating of a material in which organic photoconductive material is dispersed in a resin binder. The charge generating layer receives light and generates positive hole-electron pairs.

Under the electric field applied onto the photosensitive layer, the positive hole-electron pairs that are generated here shift to the photosensitive layer interface according to each of their polarities.

The movement of each of the positive holes and electrons from the charge generating layer preferably has low electric field dependence and has good injection even at low electric fields. For the charge generating substance in the charge generating layer, various metals, metal-free phthalocyanine compound, polycyclic quinone compounds, and their derivatives as shown in the following concrete examples I-1–I-4 can be used.

I-1

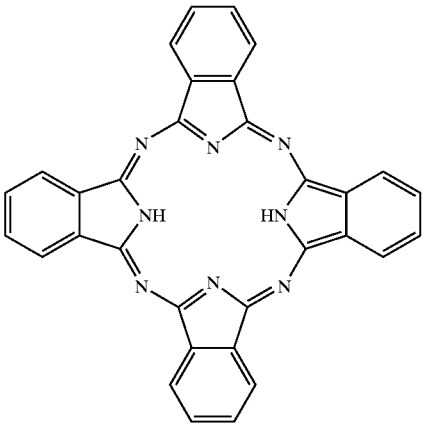

I-2

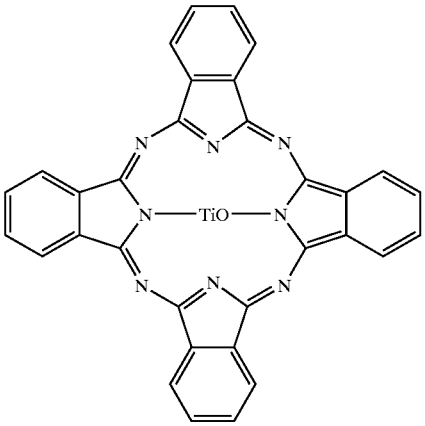

I-3

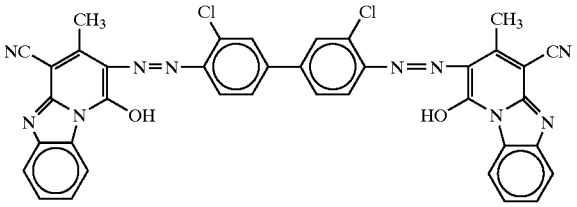

I-4

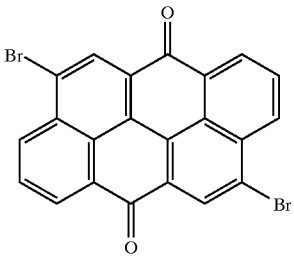

For the binder used in the charge generating layer, polycarbonate, polyester, polyamide, polyurethane, epoxy, polyvinyl butyral, polyvinyl acetal, phenoxy resin, silicone resin, acryl resin, vinyl chloride resin, vinylidene chloride resin, vinyl acetate resin, formal resin, cellulose resin, or their co-polymers, or their halogenated or cyanoethylated compounds can be used. The thickness of the charge generating layer is 0.1–5 micrometers, preferably 1 micrometer or less.

For every 10 parts by weight of resin binder, the usage amount for these phthalocyanine compounds is 1–200 parts by weight and preferably 5–50 parts by weight.

The charge transport layer is a coated film of material in which organic charge transport material is dispersed in a resin binder. In dark places, it acts as an insulating layer and retains the charge of the photosensitive body. During light receiving times, it has the function of transporting charge that is injected from the charge generating layer.

For the charge transport substance in the charge transport layer, as shown in the following concrete examples II-1 through II-7, various hydrazone, styryl, diamine, butadiene, indole compounds and their mixtures can be used.

For the binder for the charge transport layer, known resins such as polycarbonate resin, polystyrene resin, polyphenylene ether resin, acryl resin, and the like have been studied, but in terms of film strength and printing resistance, polycarbonate resin is currently the best material and is widely used.

For this polycarbonate resin, as shown in concrete examples III-1–III-2, examples include resins of bisphenol A type, bisphenol Z type, and various copolymers.

II-1

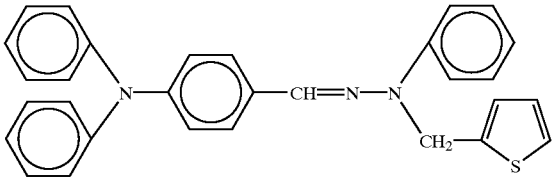

II-2

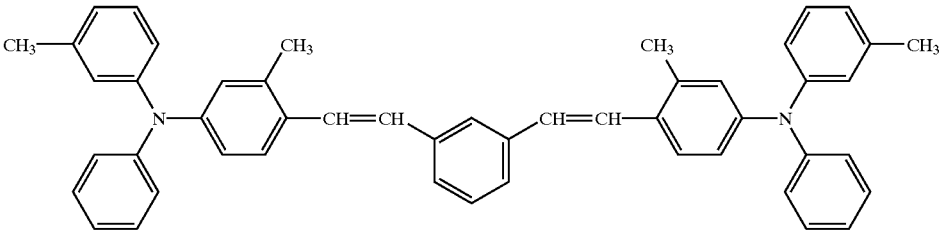

II-3

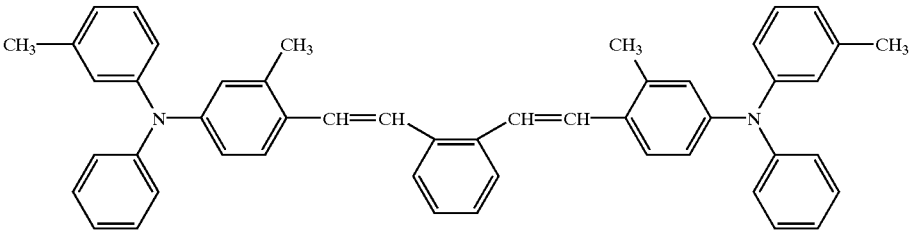

II-4

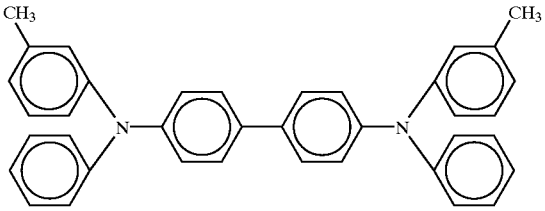

II-5

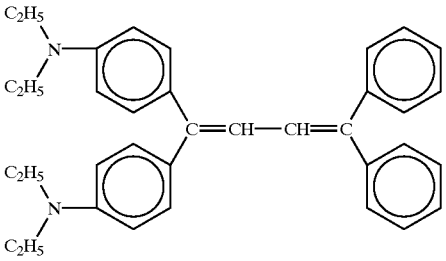

II-6

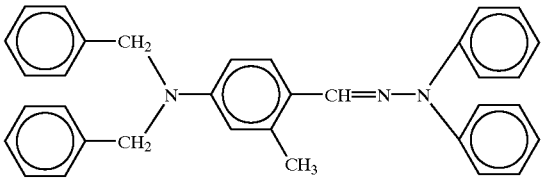

II-7

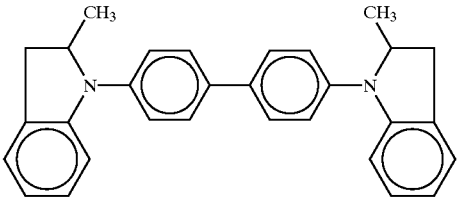

III-1

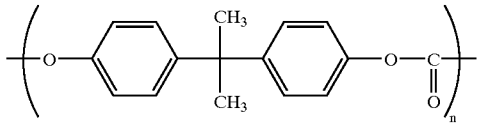

III-2

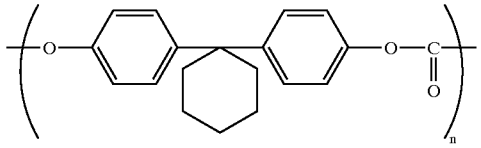

The average molecular weight range for this polycarbonate resin is 10,000–100,000. Furthermore, as an oxidation inhibiting agent that is added to the charge transport layer, an oxidation inhibiting agent as shown in the following IV-1–IV-4 can be used individually, or appropriate combinations can be used. The thickness for the charge transport layer is preferably in the range of 10–50 micrometers.

IV-1

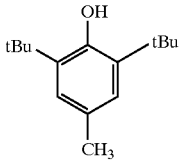

IV-2

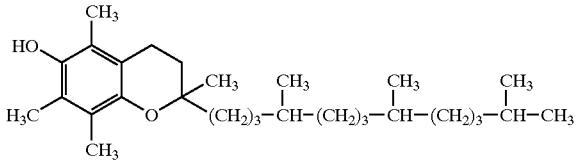

IV-3

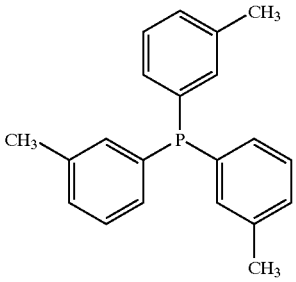

IV-4

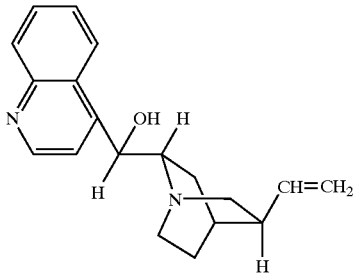

In the charge generating layer and charge transport layer, for the purposes of improving sensitivity and reducing residual electric potential or for improving environmental resistance and stability with respect to light, an electron receiving substance, oxidation inhibiting agent, light stabilizing agent, and the like can be added as needed.

In addition, for the purposes of improving environmental resistance and mechanical strength, a surface protective layer can be provided as needed on top of the photosensitive layer described above. Preferably, this surface protective layer does not greatly impede the passage of light.

The present invention is described in detail based on the embodiments.

Photosensitive Body Group 1

An aluminum cylinder (JIS-A6063 material) was cut to specified measurements (diameter: 30 mm, length 335 mm) and a specified surface roughness with a lathe. This cylinder was degreased for three minutes with an alkaline detergent (Top alclean 101: Okuno Chemical Industries Co., Ltd., concentration 30 g/l, 60 degrees C.).

Afterwards, this was rinsed thoroughly with pure water. In addition, etching was conducted for 20 seconds with an etching agent (Top alsoft 108: Okuno Chemical Industries Co., Ltd., concentration 50 g/l, 50 degrees C.). After rinsing thoroughly with pure water, neutralization was conducted with a neutralizing agent (Top desmut N20: Okuno Chemical Industries Co., Ltd.: 100 ml/l, normal temperature).

After rinsing with water, electrolysis was conducted under conditions of free sulfuric acid concentration 180 g/l, temperature 20 degrees C., current density 0.74 A/dm^2, aluminum concentration in solution 3 g/l. An aluminum anodic oxidation film of thickness 8 micrometers was formed.

With regard to the sealing that is conducted next, in order to confirm the effectiveness of the present invention, a phosphoric ester surface active agent (product name: Phosphanol RS-610 manufactured by Toho Kagaku Kogyo Corp. Ltd.) was added as a surface active agent at 0.01, 0.05, 0.1, 1.0, 2.0, 2.5, 3.0, 5.0 g/l with respect to pure water (a total of 8 types—Embodiments 1-1 through 1-8), and a pure water sealing solution which was adjusted to a pH of 5–8 with ammonium acetate was prepared.

Each aluminum cylinder, with each of the anodic oxidation films described above, was treated for 10 minutes while maintaining the temperature at 90 degrees C. and was rinsed with pure water.

Using a 2% solution of an alkaline detergent (Castrol 450: Castrol Corp. Ltd.), the surface of the resulting aluminum cylinder sample was rubbed for one minute with a nylon brush. This was rinsed with pure water and dried at 60 degrees C.

A coating solution for a charge generating layer (CGL) was prepared by dispersing material of the following composition with a dispersing device. Using this coating solution, each of the aluminum cylinder samples were dip coated. After coating, each sample was dried for 30 minutes at 100 degrees C., and a CGL of film thickness 0.3 micrometers was formed.

| | |
|---|---|
| X type metal free phthalocyanine (I-1) | 1 part |
| vinyl chloride copolymer resin (MR-110 Nihon Zeon Corp. Ltd.) | 1 part |
| methylene chloride | 98 parts |

Next, on top of this, a charge transport layer (CTL) coating solution with the following composition was dip coated. This was dried for 30 minutes at 100 degrees C., and a charge transport layer of film thickness 25 micrometers was formed. The below parts are close approximations but may not sum to exactly 100%.

| | |
|---|---|
| hydrazone charge substance: compound with formula (II-1) | 10 parts |
| binder resin: bisphenol Z type polycarbonate formula (III-2) (Panlite TS2050 manufactured by Teijin Kasei Corp. Ltd.) | 10 parts |
| oxidation inhibiting agent: BHT compound of formula (IV-1) | 0.5 parts |
| methylene chloride | 80 parts |

A layered organic photosensitive body was created as described above.

Photosensitive Body Group 2

As the surface active agent for the pure water sealing treatment, instead of the phosphoric ester surface active agent, a formaldehyde condensate of naphthalene sulfonate (product name Demol N, manufactured by Kao Corp. Ltd.) was added at 0.05, 0.1, 1.0, 2.0, 3.0, 4.0, 8.0, 10.0 g/l with respect to pure water (a total of 8 types—Embodiments 2-1 through 2-8). All else was conducted in the same manner as Photosensitive body group 1.

Photosensitive Body Group 3

As the surface active agent for the pure water sealing treatment, instead of the phosphoric ester surface active agent, a formaldehyde condensate of bisphenol A sulfonate (product name AMN-1, manufactured by Senca Corp. Ltd.) was added at 0.1, 0.2, 1.0, 3.0, 5.0, 6.0, 10.0, 20.0 g/l with respect to pure water (a total of 8 types—Embodiments 3-1 through 3-8). All else was conducted in the same manner as Photosensitive body group 1.

Photosensitive Body Group 4

As the surface active agent for the pure water sealing treatment, instead of the phosphoric ester surface active agent, an aliphatic carboxylate surface active agent (product name NS Soap, manufactured by Kao Corp. Ltd.) was added at 0.01, 0.05, 0.1, 0.5, 1.0, 5.0, 10.0, 20.0 g/l with respect to pure water (a total of 8 types—Embodiments 4-1 through 4-8). All else was conducted in the same manner as Photosensitive body group 1.

COMPARATIVE EXAMPLE 1

Everything was conducted the same as Photosensitive body group 1, except that the phosphoric ester surface active agent was not added as the surface active agent for sealing.

Photosensitive Body Group 5

As the sealing agent for sealing, nickel acetate ($Ni(CH_3COO)_2$) was added at 30 g/l with respect to pure water, and nickel acetate sealing was conducted. All else was conducted the same as Photosensitive body group 1 (total of 8 types—Embodiments 5-1 through 5-8).

Photosensitive Body Group 6

As the sealing agent for sealing, nickel acetate was added at 30 g/l with respect to pure water. All else was conducted the same as Photosensitive body group 2 (total of 8 types—Embodiments 6-1 through 6-8).

Photosensitive Body Group 7

As the sealing agent for sealing, nickel acetate was added at 30 g/l with respect to pure water. All else was conducted the same as Photosensitive body group 3 (total of 8 types—Embodiments 7-1 through 7-8).

Photosensitive Body Group 8

As the sealing agent for sealing, nickel acetate was added at 30 g/l with respect to pure water. All else was conducted the same as Photosensitive body group 4 (total of 8 types—Embodiments 8-1 through 8-8).

COMPARATIVE EXAMPLE 2

As the sealing agent for sealing, nickel acetate was added at 30 g/l with respect to pure water. All else was conducted the same as Comparative example 1.

Method of Evaluation

Each photosensitive body sample created in each of the above Embodiments and Comparative examples were charged by a contact charging device. The samples were attached to a Hewlett Packard LaserJet 5, which is a semiconductor laser printer of a reverse developing system. Evaluation of print image quality was conducted.

The evaluation of print image quality was measured in an environment of temperature 20 degrees C. and humidity 55% using A4 paper. After printing one sheet of an image with a printing area of approximately 5%, a solid white image is printed.

The number of black spots of diameter approximately 0.1–0.5 mm present in a 100 cm^2 range of solid white printed image was measured by visual examination. Samples with 0 black spots were given a total evaluation of circle, samples with 1–10 were given a triangle, and ones with 11 or more were given an x.

The evaluation results as described above are shown in the following Tables 1 and 2.

TABLE 1

| | Surface Active Agent | | Sealing Agent | | Num. of printing defects of DIA | |
|---|---|---|---|---|---|---|
| Embodiment | | Conc. in (g/l) | | Conc. in (g/l) | approx 0.1–0.5 mm (100 $cm^2$) | Overall Judgment |
| 1-1 | Phosphoric ester | 0.01 | None | — | 9 | Δ |
| 1-2 | surface active | 0.05 | | | 4 | Δ |
| 1-3 | agent | 0.1 | | | 0 | ○ |
| 1-4 | Phosphanol | 1.0 | | | 0 | ○ |
| 1-5 | RS-610 | 2.0 | | | 0 | ○ |
| 1-6 | | 2.5 | | | 5 | Δ |
| 1-7 | | 3.0 | | | 8 | Δ |
| 1-8 | | 5.0 | | | 7 | Δ |
| 2-1 | Formaldehyde | 0.05 | None | — | 3 | Δ |
| 2-2 | condensate of | 0.1 | | | 0 | ○ |
| 2-3 | Naphthalene | 1.0 | | | 0 | ○ |
| 2-4 | Sulfonate | 2.0 | | | 0 | ○ |
| 2-5 | Demol N | 3.0 | | | 0 | ○ |
| 2-6 | | 4.0 | | | 1 | Δ |

TABLE 1-continued

| Embodiment | Surface Active Agent | Conc. in (g/l) | Sealing Agent | Conc. in (g/l) | Num. of printing defects of DIA approx 0.1–0.5 mm (100 cm$^2$) | Overall Judgment |
|---|---|---|---|---|---|---|
| 2-7 | | 8.0 | | | 5 | Δ |
| 2-8 | | 10.0 | | | 7 | Δ |
| 3-1 | Formaldehyde | 0.1 | None | — | 4 | Δ |
| 3-2 | condensate of | 0.2 | | | 0 | ○ |
| 3-3 | bisphenol A | 1.0 | | | 0 | ○ |
| 3-4 | sulfonate | 3.0 | | | 0 | ○ |
| 3-5 | AMN-1 | 5.0 | | | 0 | ○ |
| 3-6 | | 6.0 | | | 2 | Δ |
| 3-7 | | 10.0 | | | 5 | Δ |
| 3-8 | | 20.0 | | | 4 | Δ |
| 4-1 | Aliphatic | 0.01 | None | — | 8 | Δ |
| 4-2 | carboxylate | 0.05 | | | 3 | Δ |
| 4-3 | NS Soap | 0.1 | | | 5 | Δ |
| 4-4 | | 0.5 | | | 2 | Δ |
| 4-5 | | 1.0 | | | 7 | Δ |
| 4-6 | | 5.0 | | | 6 | Δ |
| 4-7 | | 10.0 | | | 10 | Δ |
| 4-8 | | 20.0 | | | 10 | Δ |
| Comparative Example 1 | None | — | None | — | 15 | X |

TABLE 2

| Embodiment | Surface Active Agent | Conc. in (g/l) | Sealing Agent | Conc. in (g/l) | Num. of printing defects of DIA approx 0.1–0.5 mm (100 cm$^2$) | Overall Judgment |
|---|---|---|---|---|---|---|
| 5-1 | Phosphoric ester | 0.01 | Nickel | 30 | Many | X |
| 5-2 | surface active | 0.05 | Acetate | | 9 | Δ |
| 5-3 | agent | 0.1 | | | 0 | ○ |
| 5-4 | Phosphanol | 1.0 | | | 0 | ○ |
| 5-5 | RS-610 | 2.0 | | | 0 | ○ |
| 5-6 | | 2.5 | | | 3 | Δ |
| 5-7 | | 3.0 | | | 6 | Δ |
| 5-8 | | 5.0 | | | 16 | X |
| 6-1 | Formaldehyde | 0.05 | Nickel | 30 | 25 | X |
| 6-2 | condensate of | 0.1 | Acetate | | 0 | ○ |
| 6-3 | Naphthalene | 1.0 | | | 0 | ○ |
| 6-4 | Sulfonate | 2.0 | | | 0 | ○ |
| 6-5 | Demol N | 3.0 | | | 0 | ○ |
| 6-6 | | 4.0 | | | 3 | Δ |
| 6-7 | | 8.0 | | | 14 | X |
| 6-8 | | 10.0 | | | Many | X |
| 7-1 | Formaldehyde | 0.1 | Nickel | 30 | 9 | Δ |
| 7-2 | condensate of | 0.2 | Acetate | | 0 | ○ |
| 7-3 | bisphenol A | 1.0 | | | 0 | ○ |
| 7-4 | sulfonate | 3.0 | | | 0 | ○ |
| 7-5 | AMN-1 | 5.0 | | | 0 | ○ |
| 7-6 | | 6.0 | | | 8 | Δ |
| 7-7 | | 10.0 | | | 15 | X |
| 7-8 | | 20.0 | | | 11 | X |
| 8-1 | Aliphatic | 0.01 | Nickel | 30 | Many | X |
| 8-2 | carboxylate | 0.05 | Acetate | | Many | X |
| 8-3 | NS Soap | 0.1 | | | 20 | X |
| 8-4 | | 0.5 | | | 28 | X |
| 8-5 | | 1.0 | | | 8 | X |
| 8-6 | | 5.0 | | | 14 | X |
| 8-7 | | 10.0 | | | Many | X |
| 8-8 | | 20.0 | | | Many | X |
| Comparative Example 2 | None | — | Nickel Acetate | 30 | Many | X |

From Tables 1 and 2, with respect to Embodiments 1-1 through 1-8 relating to pure water sealing with a phosphoric ester surface active agent, when the surface active agent concentration was 0.01–5.0 g/l, the number of printing defects (black spots) was judged to be a triangle or circle.

The action of the present invention in preventing the formation of sealing deposits is seen, and this indicates that the present invention is effective in preventing insulation damage. In particular, at 0.1–2.0 g/l, these show the superior effect of having absolutely no black spots.

Similarly, with Photosensitive body groups 2 through 8, with each type of surface active agent, although there are differences in the concentration range at which the effectiveness is seen and the degree of effectiveness, compared to the comparative examples in which a surface active agent was not used, the embodiments of the present invention have superior results.

The surface active agent concentration range at which the effect of the present invention was confirmed for pure water sealing, Photosensitive body group 2 was at a concentration range of 0.05–10.0 g/l, and a dramatically superior effect was seen at 0.1–3.0 g/l.

For pure water sealing, Photosensitive body group 3, the effect was seen at a concentration range of 0.1–20.0 g/l, and a dramatically superior effect was seen at 0.2–5.0 g/l.

For pure water sealing, Photosensitive body group 4, the effect was seen at a concentration range of 0.01–20.0 g/l.

For nickel acetate sealing, Photosensitive body group 5, the effect was seen at a concentration range of 0.05–3.0 g/l, and a dramatically superior effect was seen at 0.1–2.0 g/l.

For nickel acetate sealing, Photosensitive body group 6, the effect was seen at a concentration range of 0.1–4.0 g/l, and a dramatically superior effect was seen at 0.1–3.0 g/l.

For nickel acetate sealing, Photosensitive body group 7, the effect was seen at a concentration range of 0.1–6.0 g/l, and a dramatically superior effect was seen at 0.2–5.0 g/l.

For nickel acetate sealing, Photosensitive body group 8, the effect was seen at a concentration of 1.0 g/l.

According to the present invention, with a photosensitive body having a substrate that has a sealed aluminum anodic oxidation film on its surface and a photosensitive layer on top of this substrate surface, the sealed aluminum anodic oxidation film is sealed by a sealing agent in which an anion surface active agent is added.

With this electrophotography photosensitive body substrate and electrophotography photosensitive body, minor insulation damage in the photosensitive layer during contact charging is prevented.

Printing defects of black spots and white spots and the like of diameter of approximately 0.1–0.5 mm which are detrimental for practical use are suppressed. Furthermore, the present invention is particularly effective in electrophotography photosensitive bodies and electrophotography devices that are used in contact charging processes of a reverse developing system.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A method for image formation comprising the step of charging an electrophotography photosensitive body by direct contact of a charging member with the electrophotography photosensitive body, a substrate of the electrophotography photosensitive body comprising:

an aluminum anodic oxidation film on a surface of said substrate, wherein:

said anodic oxidation film is a film that is sealed by a sealing agent comprising pure water and an anion surface active agent, the anion surface active agent being a phosphoric ester surface active agent at a concentration of 0.1–2.0 g/L with respect to water.

2. A method as described in claim 1, wherein:

said sealed aluminum anodic oxidation film is a film that is sealed by a sealing agent in which an anion surface active agent is added in an amount necessary for preventing the formation of sealing deposits.

3. A method as described in claim 1, wherein:

nickel acetate is added to said sealing agent.

4. A method for image formation comprising the step of charging an electrophotography photosensitive body by direct contact of a charging member with the electrophotography photosensitive body, a substrate of the electrophotography photosensitive body comprising:

an aluminum anodic oxidation film on a surface of said substrate, wherein:

said anodic oxidation film is a film that is sealed by a sealing agent comprising pure water and an anion surface active agent, the anion surface active agent being a formaldehyde condensate of naphthalene sulfonate at a concentration of 0.1–3.0 g/L with respect to water.

5. A method as described in claim 4, wherein:

said sealed aluminum anodic oxidation film is a film that is sealed by a sealing agent in which the anion surface active agent is added in an amount necessary for preventing the formation of sealing deposits.

6. A method as described in claim 4, wherein:

nickel acetate is added to said sealing agent.

7. A method for image formation comprising the step of charging an electrophotography photosensitive body by direct contact of a charging member with the electrophotography photosensitive body, a substrate of the electrophotography photosensitive body comprising:

an aluminum anodic oxidation film on a surface of said substrate, wherein:

said anodic oxidation film is a film that is sealed by a sealing agent comprising pure water and an anion surface active agent, the anion surface active agent being a formaldehyde condensate of bisphenol A sulfonate at a concentration of 0.2–5.0 g/L with respect to water.

8. A method as described in claim 7, wherein:

said sealed aluminum anodic oxidation film is a film that is sealed by a sealing agent in which an anion surface active agent is added in an amount necessary for preventing the formation of sealing deposits.

9. A method as described in claim 7, wherein:

nickel acetate is added to said sealing agent.

10. An electrophotography device, comprising:

an electrophotography photosensitive body;

said electrophotography photosensitive body having an electrophotography photosensitive body substrate;

said electrophotography photosensitive body substrate having an aluminum anodic oxidation film on its surface and being used in a contact charging process, wherein:

said anodic oxidation film is a film that is sealed by a sealing agent comprising pure water and an anion surface active agent, the anion surface active agent being a phosphoric ester surface active agent at a concentration of 0.1–2.0 g/L with respect to water; and a contact charging device.

11. An electrophotography device, as described in claim 10, wherein:

said electrophotography device is a reverse development system.

12. An electrophotography device, comprising:

an electrophotography photosensitive body;

said electrophotography photosensitive body having an electrophotography photosensitive body substrate;

said electrophotography photosensitive body substrate having an aluminum anodic oxidation film on its surface and being used in a contact charging process, wherein:

said anodic oxidation film is a film that is sealed by a sealing agent comprising pure water and an anion surface active agent, the anion surface active agent being a formaldehyde condensate of naphthalene sulfonate at a concentration of 0.1–3.0 g/L with respect to water; and a contact charging device.

13. An electrophotography device, as described in claim 12, wherein:

said electrophotography device is a reverse development system.

14. An electrophotography device, comprising:

an electrophotography photosensitive body;

said electrophotography photosensitive body having an electrophotography photosensitive body substrate;

said electrophotography photosensitive body substrate having an aluminum anodic oxidation film on its surface and being used in a contact charging process, wherein:

said anodic oxidation film is a film that is sealed by a sealing agent comprising pure water and an anion surface active agent, the anion surface active agent being a formaldehyde condensate of bisphenol A at a concentration of 0.2–5.0 g/L with respect to water; and a contact charging device.

15. An electrophotography device, as described in claim 14, wherein:

said electrophotography device is a reverse development system.

* * * * *